US009061401B2

(12) United States Patent
Lin

(10) Patent No.: US 9,061,401 B2
(45) Date of Patent: Jun. 23, 2015

(54) HEX WRENCH HAVING GREATER STRENGTH

(71) Applicant: Liang-Hui Lin, Taichung (TW)

(72) Inventor: Liang-Hui Lin, Taichung (TW)

( * ) Notice: Subject to any disclaimer, the term of this patent is extended or adjusted under 35 U.S.C. 154(b) by 446 days.

(21) Appl. No.: 13/684,482

(22) Filed: Nov. 23, 2012

(65) Prior Publication Data

US 2013/0074662 A1 Mar. 28, 2013

Related U.S. Application Data

(63) Continuation-in-part of application No. 12/648,591, filed on Dec. 29, 2009.

(51) Int. Cl.
*B25B 15/00* (2006.01)

(52) U.S. Cl.
CPC ..... *B25B 15/008* (2013.01); *B25B 15/001* (2013.01)

(58) Field of Classification Search
CPC .... B25B 15/008; B25B 15/001; B25B 23/108
USPC ..... 81/436–461
See application file for complete search history.

(56) References Cited

U.S. PATENT DOCUMENTS

| | | | | |
|---|---|---|---|---|
| 1,049,455 | A | 7/1913 | Clarkson | |
| 2,066,132 | A | 12/1936 | Zihler | |
| 2,679,778 | A * | 6/1954 | Krafft | 81/439 |
| 4,191,228 | A | 3/1980 | Fenton | |
| 5,440,954 | A | 8/1995 | Stevens | |
| 6,367,567 | B1 * | 4/2002 | Massa et al. | 175/323 |
| 6,464,588 | B1 | 10/2002 | Rupp | |
| 7,247,780 | B2 | 7/2007 | Sanders et al. | |
| 7,603,931 | B1 | 10/2009 | Powell | |
| 2005/0166724 | A1 | 8/2005 | Castaneda | |

* cited by examiner

*Primary Examiner* — Bryan R Muller
(74) *Attorney, Agent, or Firm* — Muncy, Geissler, Olds & Lowe, P.C.

(57) ABSTRACT

A hex wrench includes a handle with a first twist portion having a substantially helical profile through an entire length thereof, a head with a second twist portion having a substantially helical profile through an entire length thereof, and a curved transition portion connected between the handle and the head. A first mounting portion which is a regular hexagonal prism and non-twisted extends integrally from the handle, and a second mounting portion which is a regular hexagonal prism and non-twisted extends integrally from the head. As such, the hex wrench has greater strength and stiffness without reducing its malleability so as to prevent the hex wrench from being cracked or broken due to an excessive applying force.

8 Claims, 2 Drawing Sheets

HEX WRENCH HAVING GREATER STRENGTH

The present invention is a CIP of application Ser. No. 12/648,591, filed Dec. 29, 2009, the entire contents of which are hereby incorporated by reference.

BACKGROUND OF THE INVENTION

1. Field of the Invention
2. Description of the Prior Art

A conventional hex wrench 1 in accordance with the prior art shown in FIG. 2 comprises a handle 11 and a head 12 connected with the handle 11. The handle 11 has a distal end provided with a first mounting portion 111. The head 12 has a distal end provided with a second mounting portion 121. In operation, the first mounting portion 111 of the handle 11 or the second mounting portion 121 of the head 12 is inserted into the hexagonal hole of a hex hole screw to rotate the hex hole screw so as to tighten or loosen the hex hole screw. At this time, the handle 11 or the head 12 is subjected to a torsional shear stress that is applied by the hex hole screw during operation of the hex wrench 1. However, the hex wrench 1 is usually made of a medium steel which has a smaller stiffness or hardness to reduce the torsional radius of the hex wrench 1 so that the hex wrench 1 is easily distorted or deformed due to an excessive applying force. Alternatively, the hex wrench 1 can be worked by a heat treatment to increase its stiffness or hardness. However, the malleability of the hex wrench 1 is decreased after the heat treatment to reduce the torque of the hex wrench 1 so that the hex wrench 1 is easily cracked or broken due to an excessive torque.

The present invention is, therefore, arisen to obviate or at least mitigate the above mentioned disadvantages.

SUMMARY OF THE INVENTION

The main object of the present invention is to provide a hex wrench which has greater strength and stiffness without reducing its malleability so as to prevent the hex wrench from being cracked or broken due to an excessive applying force, thereby enhancing the lifetime of the hex wrench, and has a greater torque to withstand a larger torsional shear stress.

To achieve the above and other objects, a hex wrench includes an elongated body portion, a first mounting portion and a second mounting portion. The elongated body portion has a handle, a head, a curved transition portion and six side faces around a longitudinal axis of the hex wrench. The handle and the head are integrally connected respectively to two ends of the curved transition portion. The six side faces each continuously extend through an entire length of the elongated body portion. The first mounting portion extends integrally from one end of the handle. The first mounting portion is a regular hexagonal prism and has six first faces around the longitudinal axis, and the six first faces are non-twisted about the longitudinal axis. The second mounting portion extends integrally from one end of the head. The second mounting portion is a regular hexagonal prism and has six second faces around the longitudinal axis, and the six second faces are non-twisted about the longitudinal axis. The handle includes a first twist portion having a substantially helical profile through an entire length thereof. The head includes a second twist portion having a substantially helical profile through an entire length thereof. Either of the first and second mounting portions is to be fitted in a regular hexagonal hole of a fastener.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
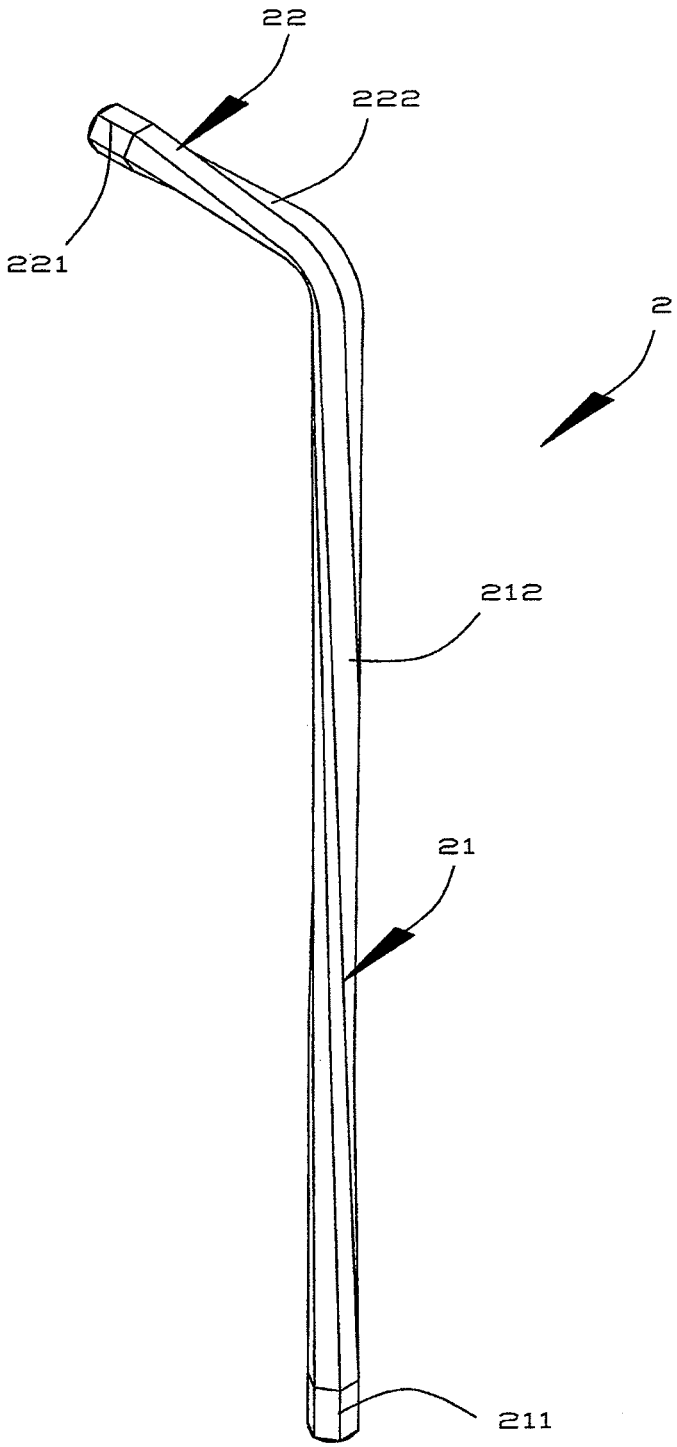
FIG. 1 is a perspective view of a hex wrench in accordance with the preferred embodiment of the present invention.
Figure 2:
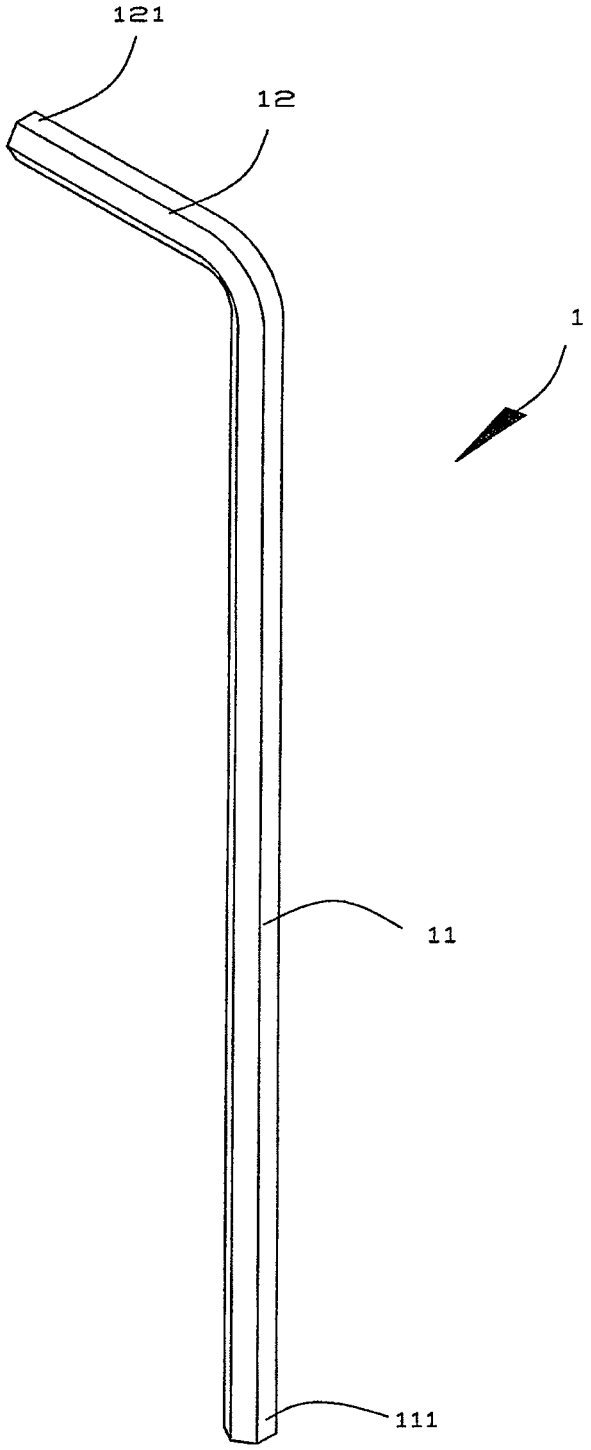
FIG.2 PRIOR ART
FIG. 2 is a perspective view of a conventional hex wrench in accordance with the prior art.

Referring to FIG. 1, a hex wrench 2 in accordance with the preferred embodiment of the present invention comprises a handle 21 and a head 22 connected with the handle 21.

The handle 21 has a distal end provided with a first mounting portion 211. The first mounting portion 211 of the handle 21 has an axis that is parallel with the axis of the handle 21. The handle 21 has a surface provided with a first twist portion 212. The first twist portion 212 of the handle 21 has an axis that is not parallel with the axis of the handle 21. Preferably, the first twist portion 212 of the handle 21 has a substantially helical profile.

The head 22 has a distal end provided with a second mounting portion 221. The second mounting portion 221 of the head 22 has an axis that is parallel with the axis of the head 22. The head 22 has a surface provided with a second twist portion 222. The second twist portion 222 of the head 22 has an axis that is not parallel with the axis of the head 22. Preferably, the second twist portion 222 of the head 22 has a substantially helical profile.

The first twist portion 212 of the handle 21 has a first end connected with the first mounting portion 211 of the handle 21 and a second end connected with the second twist portion 222 of the head 22, and the second twist portion 222 of the head 22 has a first end connected with the second mounting portion 221 of the head 22 and a second end connected with the first twist portion 212 of the handle 21.

In operation, the first mounting portion 211 of the handle 21 or the second mounting portion 221 of the head 22 is inserted into the hexagonal hole of a hex hole screw to rotate the hex hole screw so as to tighten or loosen the hex hole screw. At this time, the handle 21 or the head 22 is subjected to a torsional shear stress that is applied by the hex hole screw during operation of the hex wrench 2. In such a manner, the first twist portion 212 of the handle 21 has an axis that is not parallel with the axis of the handle 21 and has a substantially helical profile, and the second twist portion 222 of the head 22 has an axis that is not parallel with the axis of the head 22 and has a substantially helical profile, so that the first twist portion 212 of the handle 21 and the second twist portion 222 of the head 22 can withstand and tolerate the torsional shear stress applied by the hex hole screw so as to enhance the strength and stiffness of the hex wrench 2 without reducing the malleability of the hex wrench 2 and to prevent the hex wrench 2 from being cracked or broken due to an excessive applying force, thereby enhancing the lifetime of the hex wrench 2.

As shown in FIG. 1, in an alternative embodiment, the hex wrench 2 may include an elongated body portion, a first mounting portion 211 and a second mounting portion 221. The elongated body portion has a handle 21, a head 22, a curved transition portion and six side faces around a longitudinal axis of the hex wrench 2. The six side faces each continuously extend through an entire length of the elongated body portion. The elongated body portion has six longitudinal edges each continuously extending through the entire length of the elongated body portion. The elongated body portion may have a helical profile extending successively through the entire length of the elongated body portion.

The handle 21 and the head 22 are integrally connected respectively to two ends of the curved transition portion, and the handle 21 and the head 22 are angled relative to each other so that the hex wrench 2 is convenient to use and applied force-saving. The handle 21 includes a first twist portion 212 having a substantially helical profile through an entire length thereof. The first mounting portion 211 extends integrally from one end of the handle 21. The first mounting portion 211 is a regular hexagonal prism and has six first faces around the longitudinal axis, and the six first faces are non-twisted about the longitudinal axis. The first mounting portion 211 has six longitudinal first mounting edges, and each of the first mounting edges extends continuously from one corresponding longitudinal edge of the elongated body portion.

The head 22 includes a second twist portion 222 having a substantially helical profile through an entire length thereof. The second mounting portion 221 extends integrally from one end of the head 22. The second mounting portion 221 is a regular hexagonal prism and has six second faces around the longitudinal axis, and the six second faces are non-twisted about the longitudinal axis. The second mounting portion 221 has six longitudinal second mounting edges, and each of the second mounting edges extends continuously from one corresponding longitudinal edge of the elongated body portion.

Either of the first twist portion 212 and the second mounting portion 221 is to be fitted in a regular hexagonal hole of a fastener. The first twist portion 212 and the second twist portion 222 are twisted at an angle preferably less than fifteen degrees relative to the longitudinal axis, respectively.

Preferably, the curved transition portion is smoothly connected between the first twist portion 212 and the second twist portion 222 with no height-drop. The six first faces of the first mounting portion 211 are arranged respectively in alignment correspondingly with the six side faces, and every corresponding first face and side face has a common end edge. The six second faces of the second mounting portion 221 are arranged respectively in alignment correspondingly with the six side faces, and every corresponding second face and side face has a common end edge.

Accordingly, each of the first twist portion 212 of the handle 21 and the second twist portion 222 of the head 22 has a substantially helical profile to conform to the torsional shear stress applied by the hex hole screw during operation of the hex wrench 2 so that the hex wrench 2 has greater strength and stiffness without reducing its malleability so as to prevent the hex wrench 2 from being cracked or broken due to an excessive applying force, thereby enhancing the lifetime of the hex wrench 2. In addition, each of the first twist portion 212 of the handle 21 and the second twist portion 222 of the head 22 has an axis that is not parallel with the axis of the handle 21 and the head 22 respectively so that the hex wrench 2 has a greater torque to withstand a larger torsional shear stress.

Moreover, since either of the first mounting portion 211 and the second mounting portion 221 is a regular hexagonal prism, the either of the first mounting portion 211 and the second mounting portion 221 will not disengage from a regular hexagonal hole of a fastener during screwing or unscrewing the fastener. It is noted that if a wrench is provided with a mounting portion shaped in a twisted profile, the wrench can be applied only for a fastener having a specific twisted hexagonal hole, and the twisted mounting portion can disengage from the twisted hexagonal hole during screwing or unscrewing the fastener.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A hex wrench, comprising:

an elongated body portion, having a handle, a head, a curved transition portion and six side faces around a longitudinal axis of the hex wrench, the handle and the head integrally connected respectively to two ends of the curved transition portion, the six side faces each continuously extending through an entire length of the elongated body portion;

a first mounting portion, extending integrally from one end of the handle, the first mounting portion being a regular hexagonal prism and having six first faces around the longitudinal axis, the six first faces being non-twisted about the longitudinal axis; and a second mounting portion, extending integrally from one end of the head, the second mounting portion being a regular hexagonal prism and having six second faces around the longitudinal axis, the six second faces being non-twisted about the longitudinal axis;

wherein the handle includes a first twist portion with the six side faces having a substantially helical profile through an entire length of the handle from the curved transition portion to the first mounting portion;

wherein the head includes a second twist portion with the six side faces having a substantially helical profile through an entire length of the head from the curved transition portion to the second mounting portion;

wherein either of the first and second mounting portions is to be fitted in a regular hexagonal hole of a fastener.

2. The hex wrench of claim 1, wherein the first twist portion is twisted at an angle less than fifteen degrees relative to the longitudinal axis.

3. The hex wrench of claim 1, wherein the second twist portion is twisted at an angle less than fifteen degrees relative to the longitudinal axis.

4. The hex wrench of claim 1, wherein the curved transition portion is smoothly connected between the first twist portion and the second twist portion.

5. The hex wrench of claim 1, wherein the six first faces of the first mounting portion are arranged respectively in alignment correspondingly with the six side faces, and every corresponding first face and side face has a common end edge.

6. The hex wrench of claim 5, wherein the elongated body portion has six longitudinal edges each continuously extending through the entire length of the elongated body portion, the first mounting portion has six longitudinal first mounting edges, and each of the first mounting edges extends continuously from one corresponding longitudinal edge of the elongated body portion.

7. The hex wrench of claim 1, wherein the six second faces of the second mounting portion are arranged respectively in alignment correspondingly with the six side faces, and every corresponding second face and side face has a common end edge.

8. The hex wrench of claim 7, wherein the elongated body portion has six longitudinal edges each continuously extending through the entire length of the elongated body portion, the second mounting portion has six longitudinal second mounting edges, and each of the second mounting edges extends continuously from one corresponding longitudinal edge of the elongated body portion.

* * * * *